United States Patent [19]

Doundoulakis

[11] 3,989,012

[45] Nov. 2, 1976

[54] THREE-ROTOR ENGINE

[75] Inventor: George J. Doundoulakis, North Bellmore, N.Y.

[73] Assignees: William J. Casey, Roslyn; Helias Doundoulakis, Baldwin, both of N.Y. ; part interest to each

[22] Filed: Mar. 3, 1975

[21] Appl. No.: 554,560

[52] U.S. Cl. ..... 123/8.47; 123/8.05; 418/36

[51] Int. Cl.[2] ..... F02B 53/00

[58] Field of Search ..... 123/8.05, 8.47, 64; 418/33, 35, 36

[56] References Cited

UNITED STATES PATENTS

| | | | |
|---|---|---|---|
| 987,929 | 3/1911 | Thomas | 123/8.47 X |
| 1,568,051 | 1/1926 | Bullington | 123/8.05 |
| 1,695,704 | 12/1928 | Archer | 123/64 X |
| 1,882,971 | 10/1932 | Sohimanek | 123/64 |
| 2,687,609 | 8/1954 | Mallinckrodt | 123/8.47 X |

*Primary Examiner*—Carlton R. Croyle
*Assistant Examiner*—Michael Koczo, Jr.
*Attorney, Agent, or Firm*—Constantine Michalos

[57] ABSTRACT

This is a continuation-in-part to a previous patent application now pending entitled Two-Rotor Engine, Ser. No. 542,250. In accord with said patent pending, the present invention also involves an engine comprising a cavity of genus 1 generated by the revolution of a rectangle about an axis. Two sets of diaphragms with n diaphragms in each set are alternated inside the cavity of revolution, separating the cavity in $2n$ chambers, the volume of $n$ chambers increasing while the volume of the other $n$ chambers is decreasing when the two sets of diaphragms are forced to rotate with respect to each other. In the present invention, one set of diaphragms is attached to a center rotor, the other set being attached to a side rotor. While in the Two-Rotor Engine, the two sets of diaphragms are attached to the two side rotors which, in turn, are connected to the two side gears of a differential assembly. The changing of volume of chambers is used to execute complex thermodynamic cycles. A novel concept is disclosed where fixed volume heat-exchanging pressure chambers are used to contain gas, the pressure of which is increased by the heat of the engine. This pressure is later communicated to the variable volume chambers to be converted to useful torque. The novel methods and means are illustrated in terms of an example pertaining to an overall efficient vehicle engine. A cycle consisting of four modified Otto sub-cycles recovers heat by afterburning of exhaust gases and by processing cool air in dummy Otto sub-cycles in conjunction with the aforesaid pressure chambers. Extra torque can be provided during emergencies by feeding fuel to such dummy Otto sub-cycles normally processing only hot air. The overall efficiency of a car engine can be further enhanced by use of dynamic braking. Several advantages of the Three-Rotor Engine over the Two-Rotor Engine are presented. The present invention can be applied in the design of steam engines, hydrostatic engines, gasoline engines, Diesel engines, fluid measuring devices, and pumps.

23 Claims, 10 Drawing Figures

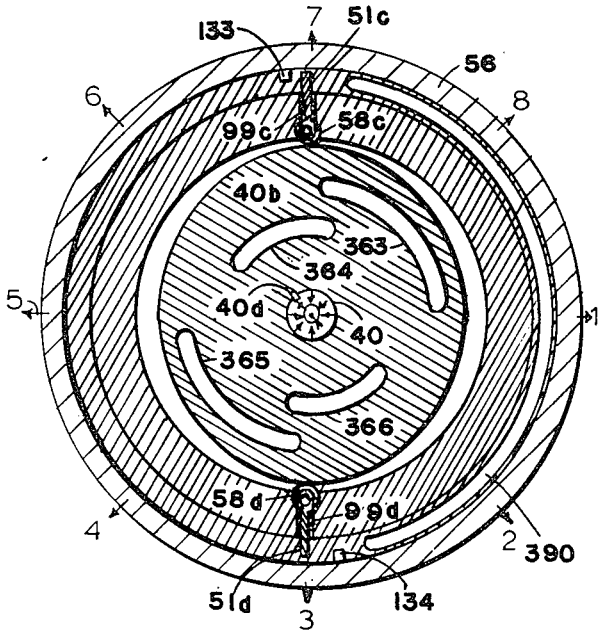
FIG. 7
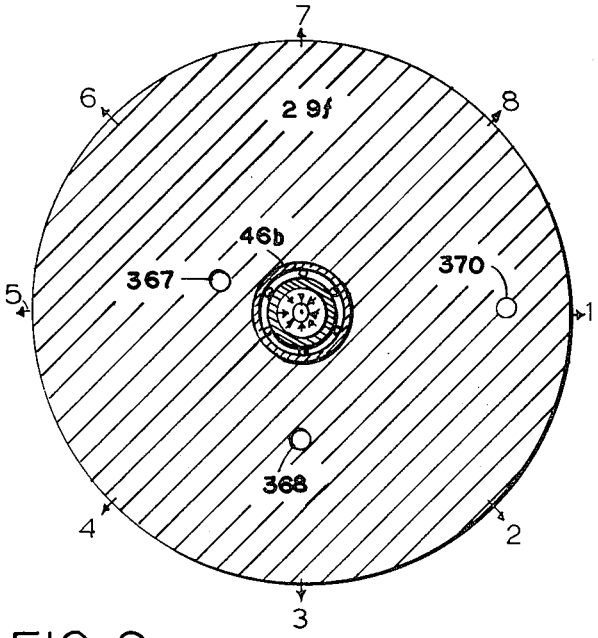
FIG. 8
| PLANES | TIME STROKE INTERVALS | | | |
|---|---|---|---|---|
| 1 - 7 | A / A | | A / A | |
| 2 - 8 | b / | / c | b / | / c |
| 3 - 1 | | D / D | | D / D |
| 4 - 2 | / b | a / | / b | a / |
| 5 - 3 | C / C | | C / | |
| 6 - 4 | d / | / a | d / C | / a |
| 7 - 5 | | B / B | | B / B |
| 8 - 6 | / d | c / | / d | c / |
| | 1 | 2 | 3 | 4 |
FIG. 9
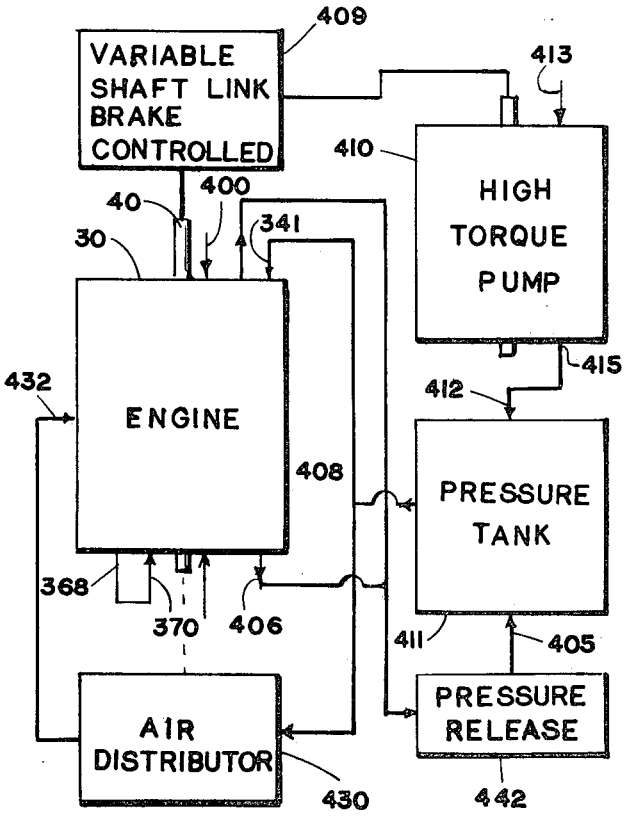
FIG. 10

THREE-ROTOR ENGINE

FIELD OF THE INVENTION

The invention relates to engines for converting engine into torque. More specifically it relates to the field of multi-stroke engines generating torque with respect to a housing. In particular the invention involves three rotors providing torque with respect to a housing and methods for increasing efficiency as a continuation in part to my application Ser. No. 542,250.

DESCRIPTION OF THE PRIOR ART

There are known in the prior art, multi-stroke engines which are converting energy into torque. Two well-known configurations of such engines are the piston engines and the rotary engine, also known as the Wankel engine. A patent application Ser. No. 542,250 filed with the U.S. Patent Office, provided a detailed description of multi-stroke engines and covered a novel configuration of a rotary engine entitled "TWO-ROTOR ENGINE." The Two-Rotor Engine also consists of three rotors; but torque is generated as a result of forces involving the two side rotors, with the center rotor being used to provide rotation equal to the average rotation of the two side rotors. The Three-Rotor Engine covered by the present invention generates torque as a result of forces involving a third rotor rotating with the center shaft and one or both of the side rotors. The rotors operate through diaphragms revolving inside a cavity of revolution. The cavity of revolution is formed by walls provided by at least the rotors which contribute diaphragms to the cavity, and may or may not include stationary walls belonging to the housing.

The Wankel engine has been operated as a gasoline engine in accordance with the well-known Otto cycle. The piston engines have been operated in the Otto cycle and also in the well-known Diesel cycle. In said patent application I have shown the Two-Rotor Engine to be capable of being operated in both the Otto cycle, the Diesel cycle and also other cycles which I consider novel and in which additional strokes are executed for the conversion of some of the heat, normally wasted in a cooling system and the hot exhaust, into useful torque.

The piston engines and the Wankel engine in their present form are thermally inefficient. It is a well known fact that under optimum conditions the efficiency of the piston gasoline engine is around 25 percent; while the efficiency of the piston engine operated in the Diesel cycle is about 35 percent. The Wankel engine has made no improvement in thermal efficiency over the piston engines. It has been reported in the literature about engines that of the 75 percent of the fuel being lost in the gasoline engines, approximately 36 percent is going to the cooling system, 34 percent is getting lost with the hot exhaust gases, and 5 percent is dissipated in friction in bearings and other sliding surfaces. The Diesel engine is thermally more efficient, but again, close to two-thirds of the fuel energy is being wasted in the cooling system and the hot exhaust. According to a study by the Rand Corporation in 1972, cars, trucks, and buses in the United States consumed about 18 percent of the total energy used by this country, amounting to 6.4 million barrels of crude oil per day. Therefore about 12 percent of the total energy, or about 2 million barrels of crude oil per day, are being wasted in the cooling system and the hot exhaust of the engines in cars, trucks, and buses.

The 25 percent efficiency figure is a rather optimistic picture. According to an article by John R. Pierce, entitled "The Fuel Consumption of Automobiles" published in *Scientific American*, January 1975, pp. 34–44, "The present Otto-cycle automobile engine typically achieves a thermal efficiency of between 22 and 27 percent. Under the normal range of driving conditions, however, the net efficiency of power delivered to the wheels is only 10 percent." One reason for this sharp deterioration in actual efficiency is that cars are used primarily for short trips, so that a considerable amount of heat is being used to warm up the cooling system. Another reason is that the engines normally used in automobiles are larger than would be required to power those automobiles for normal driving. This is done to be able to provide fast accelerations for entering speedways and for avoiding accidents during getaway maneuvers.

Another complaint against the present engines is the amount of pollutants expelled through the exhaust gases into the atmosphere. These pollutants are mainly in the form of CO and $NO_x$. The CO is a result of incomplete burning of the hydrocarbons to $CO_2$ while the compounds of Nitrogen are formed in the combustion chambers while the gases are at elevated temperatures.

In said patent application I have indicated the method of using additional novel strokes in multi-stroke, complex thermodynamic cycles for recovering and converting into torque heat from: (a) semiburned hydrocarbons; (b) the internal walls of the combustion chambers; and (c) the hot gases subsequent to detonation, but prior to expulsion from the combustion chambers. It should be noted that while the method described in said application will help recover a considerable amount of heat from the hot gases and the internal walls of the combustion chambers, it does nothing about the heat being transmitted through the walls of the housing and about the heat left in the exhaust gases as they are being expelled from the combustion chambers. The present invention provides methods and means whereby such heat, which was left unused in said application, is to be now used in additional novel thermodynamic processes producing additional torque to further increase the thermal efficiency of engines. For the same size engine, additional acceleration can become available in the present invention, when needed by the addition of fuel during strokes normally processing only hot air. Conversely, during idling conditions, as would arise in heavy traffic, when the overall temperature of the engine tends to increase, a greater portion of the power required to keep the engine going would come from the heat recovered from the walls of the engine and the hot exhaust gases, as compared with the heat coming directly from the detonation of the fuel.

Present gasoline engines consume more fuel than would normally be needed to provide required torque. This is for maintaining sufficiently high fuel concentration in the combustion chamber for the carbureted air mixture to be ignited by an electric spark. The present invention can increase efficiency by providing double chambers so that while ignition can occur in a first chamber having a higher fuel concentration, detonation and expansion can proceed in both the first and second chambers. In this way the engine can be operated on an average lean fuel mixture for higher fuel efficiency. Leaner averge mixtures will also involve lower average temperatures, contributing to a reduction in the generation of oxides of nitrogen, one of the main pollutants in the internal combustion engines.

The present invention can utilize compressed air to advantage, conserving and converting whatever energy is stored in the compressed air back into torque. Kinetic energy which is now being lost during braking can be converted, through an arrangement of dynamic braking, into air pressure. During stop-and-go traffic conditions where considerable braking is used, a substantial amount of energy can be stored as potential energy, in the form of air pressure, to be converted into torque later.

The Three-Rotor Engine is a variation of the Two-Rotor Engine. In the Two-Rotor Engine, the two sets of diaphragms separating a cavity of revolution into chambers are connected alternately to the rotors rotating with the two side-bevel gears of a differential gear arrangement, with the third rotor rotating with the center shaft and the idle center bevel gear of the differential gear arrangement providing no diaphragms in the cavity of revolution. In the Three-Rotor Engine, cavity diaphragms are connected alternately to the rotor attached to the center shaft and one of the other rotors. There are certain advantages resulting from the three-rotor arrangement as follows:

1. The number of spark-plugs needed in the three-rotor engine is reduced to one-eighth of the number required in the Two-Rotor engine.

2. The speed of the center shaft is doubled so that gearing-up in speed if needed can be halved.

3. The diaphragms connected to the center shaft are not being accelerated and decelerated during strokes, but are revolving about the axis with substantially constant speed. Most of the mass involved in the diaphragms may therefore be thrown into these center-rotor diaphragms to act as a fly-wheel, while reducing the size of the diaphragms connected to the other rotor, and therefore the mass of the accelerated rotors, for faster accelerations and decelerations.

4. In the Two-Rotor engine, on the average, about 80 percent of the edge of the diaphragms is in sliding contact with either the housing or another rotor. In the Three-Rotor engine, on the average, less than 65 percent of the edge of the diaphragms is in sliding contact. Also shorter pieces of sealing elements are needed.

5. In the Three-Rotor Engine the sealing elements around the diaphragms are not crossing the intake and outlet openings; therefore no oil lubricating the sealing elements can be spilled in such openings, and no bridging blocks are needed to prevent such spillage, as are needed in the case of the Two-Rotor Engine. There is a further possibility for reducing the sliding contact down to about 50 percent of the diaphragm edge by extending the center rotor to cover most or all of the outer side of the cavity of revolution. This step would also reduce or eliminate the position of the sliding contact which rotates with twice the speed of the corresponding contact in the Two-Rotor Engine.

6. Each of the side rotors can form an independent engine with the center rotor. The Three-Rotor Engine therefore offers greater volume efficiency even than the Two-Rotor Engine, which has been shown to provide greater volume efficiency than any conventional engine.

7. The two engines in (6) may be arranged to work in unison to execute a particular complex thermodynamic cycle, providing twice the number of available chambers for the same angle of ratational displacement per stroke interval.

8. With the diaphragms which are connected to the center rotor being larger, their inside volume can conveniently be utilized as a heat exchanger.

9. The Three-Rotor Engine is a more general aspect of the Two-Rotor Engine. While the preferred embodiment described in this application involves only two cavities of revolution, each containing diaphragms attached to the center rotor and one of the side rotors, a third cavity of revolution preferably positioned between the other two cavities of revolution can be designed into the same general configuration. This third cavity would have only half the number of diaphragms of the other two cavities; these diaphragms being attached to the two side rotors as in the case of the Two-Rotor Engine. The Three-Rotor Engine therefore may be used in combination with another Three-Rotor Engine and/or in combination with a Two-Rotor Engine. Any such combination only requires a common center shaft, common differential assembly, common side rotor reverse rotation, and forward rotation limiting means.

It is also shown that additional cavities of revolution can be formed and be operated in connection with diaphragms or as pumps. Examples of such additional cavities of revolution are the spaces shown in the preferred embodiment to exist between the center shaft and the side rotors, which are now used in the preferred embodiment to contain bearings as shown in FIG. 1. These spaces, for example, can be enlarged to required size to provide cavities of revolution to two simple two-stroke pumps for the supply of the pressurized air mentioned in the preferred embodiment. It is understood that these pumps will have the same number of diaphragms as the Three-Rotor Engines. The second and third engines may be used independently, for example, as a pressure pump. Or they may be operated in unison with the other two engines in a complex thermodynamic cycle. It should be noted that the strokes per revolution will be the same in all three engines.

On the basis of the above advantages and no apparent disadvantages, the Three-Rotor Engine can do whatever the Two-Rotor Engine has been shown in said patent application to do, and in a more efficient manner. The two types of engines may also be used to complement each other.

SUMMARY

In summary the present invention provides for modifications, as a continuation-in-part, to the configuration filed as a Two-Rotor Engine with the U.S. Patent Office, Ser. No. 542,250. The present engine therefore is similar to the engine in said applications. Both engines involve three rotors, two side rotors each being connected to one of the side bevel gears of a differential assembly and a third rotor revolving with the center bevel gear of said differential assembly; a cavity of revolution divided by diaphragms which are alternately connected to two out of the three said rotors; energy for forcing, alternately, the set of diaphragms of a first, then the set of diaphragms of a second, rotor in the forward direction while the other side rotor is being forced in the reverse direction; means for limiting the reverse motion of either side rotor, whereby the center rotor rotates, in the forward direction an amount about half that rotated by the side rotor which has been rotated in the forward direction; means of limiting the forward direction of a side rotor if its angular excursion exceeds a predetermined angle. In both arrangements the relative rotation or stroke interval of one set of diaphragms with respect to the other, in the cavity of revolution, is about $180/n$ degrees where $n$ is the number of diaphragms per rotor. Both engines may be operated in a steam cycle, a hydrostatic cycle, an Otto Cycle, a Diesel Cycle, or a further complex thermodynamic cycle. Both arrangements involve a number of diaphragms per rotor, 1,2,3,5,6 etc, appropriate to accommodate a particular thermodynamic cycle, a pump or a metering device. Both engines can be used in combination with heat exchanging pressure chambers described in this application. Both engines can be used as engine 30 in combination with appropriate auxiliaries as shown in FIGS. 18, 19 and 20 of said application. Both arrangements may be used as a fluid metering device. Both arrangements may be applied to the design of a pump.

The present application provides modifications resulting in improved performance in at least nine different respects, listed above. The number of spark-plugs, for example, needed in the Three-Rotor Engine is only $n/2$, compared to $4n$ spark-plugs needed in the Two-Rotor engine, a ratio of eight to one. Intake and exhaust ports are not being crossed by the sealing elements, so no bridging blocks are needed to prevent spilling lubricating oil into such openings, etc. As in the Two-Rotor Engine, the stroke pattern, ABCD etc, moves in the Three-Rotor Engine in a counterclockwise direction if the strokes ABCD have been assigned to the chambers in a clockwise direction, but not uniformly; it is a characteristic of the Three-Rotor Engine that a stroke alternately jumps 1 and 3 half sectors prior to sweeping a whole sector in the direction of pattern movement with respect to the housing. Corresponding means for opening and closing the intake and outlet ports and for programming complex thermodynamic cycles are described in connection with a preferred embodiment.

The preferred embodiment described involves two Three-Rotor Engines working in unison and employing a single set of side rotors and associated motion limiting means. The arrangement of two engines permits detonation in a combustion chamber of a first engine, where the fuel concentration is higher, and subsequent expansion in two chambers. This contributes to higher efficiency because, on the average, leaner fuel mixtures are being processed. Also, it contributes to the reduction of the amount of pollutants in the form of oxides of nitrogen as the duration of high temperatures is shortened.

The preferred embodiment is shown working in combination with a heat-exchanging pressure chamber arrangement in which cool air is introduced and is allowed to stay for a sufficiently long duration in the pressure chambers, where its temperature is being increased as it comes in contact with the walls of the chamber, heated by the combustion of the engine, and with hot exhaust gases. Subsequently this pressure is communicated into an expanding chamber of the engine to be converted into torque. The cool air which is preferably being introduced under pressure is received from a pressure tank whose pressure can partly be derived from dynamic braking. The preferred embodiment also shows the mixture of the exhaust gases after the first burning to be recompressed for a second burning for further conversion of CO into $CO_2$. The heat derived during such afterburning contributes to further increase in pressure to be subsequently converted to torque.

The preferred embodiment is shown to devote four full strokes in processing cool air subsequent to four full strokes used in processing carborated air, for extracting heat directly out of the walls of the combustion chambers. This air is then further being processed by the heat-exchanging pressure chambers for the further extraction and use of heat conducted through the walls of the combustion chambers. It is also processed for the further burning of gases of first combustion which have been left in the pressure chambers. In the preferred embodiment, after the second burning, the exhaust gases are forced to travel outside the wall of the pressure chambers so that some of the remaining heat in the exhaust is transfered to the pressure chambers. The cool air being introduced in the system, preferably under pressure is to be sufficient to substitute for the cooling now provided to internal combustion engines by water cooling or air cooling systems. This method, therefore, accomplishes several desirable results as follows: (1) Converts heat that is otherwise being wasted in the cooling system, the hot gases, and the braking system, into torque. (2) Eliminates the weight, the cost, and the complexity of a cooling system and its associated components. (3) It provides for a smaller power engine than normally used, adequate only for normal driving; but during times when additional acceleration is needed the full cycles processing only air can, for short intervals, be fed carborated mixture, as in the case of normal cycles. While the temperature of the engine will be raised during such short intervals, the engine will quickly resume equillibrium as soon as it returns to normal driving.

OBJECTS

All objects presented in said application Ser. No. 542,250 equally apply in the present application.

It is further the main object of the present invention to provide engines with high efficiencies. Namely, high volume and weight efficiencies whereby high power engines can be provided in relatively small volume and weight; high thermal efficiency where more useful torque can be generated for the same amount of fuel; size efficiency where a small size engine can provide increased acceleration when needed during short intervals; and braking efficiency where kinetic energy during braking is stored instead of being wasted.

It is a further object of the present invention to provide engines which will not need a cooling system, and systems in which heat now being wasted in a cooling system is converted into torque; whereby a more thermally efficient, light, less complex and less expensive engine can be provided.

It is another object of the present invention to provide methods and means whereby heat conducted through the walls of combustion chambers and heat contained in the hot exhaust gases of engines is converted into torque.

A further object of the present invention is to provide methods and means whereby heat is being extracted from the hot exhaust gases during their travel from the combustion chambers to the atmosphere, and is being converted into torque.

Another object of the present disclosure is to provide methods and means for detonating a mixture of air and hydrocarbons in one combustion chamber of an internal combustion engine and subsequently allowing the hot gases to expand in more than one chamber. The detonation chamber contains sufficiently high concentration for the hydrocarbons to detonate the mixture; but immediately upon detonation the volume of an additional chamber or chambers becomes available for expansion. Thus operation results are improved in two respects: (1) The engine can be operated, on the average, by a leaner mixture of hydrocarbons per unit volume of expansion chamber with an increase in the fuel efficiency as a result and (2) the high normal temperature resulting from the detonation of the hydrocabons is reduced, thus substantially shortening the time of high temperature necessary for the formation of $NO_x$ polluting compounds.

Still another object of the present invention is to provide methods and means for substantially increasing, on demand, the output torque of an internal combustion engine from that provided by its normal output; whereby smaller engines can be used to provide the normal torque needed, as in the case of the automobiles, but such engines would be capable of providing greatly increased torque when needed for relatively short periods of time as in the case when substantially-additional acceleration is required in automobiles during entrance into speedways and to possibly avoid collisions in getaway maneuvers. The further objects of the invention will be more clearly understood when referring to the following specification.

BRIEF DESCRIPTION OF THE DRAWINGS

The invention is illustrated diagrammatically in the accompanying drawings by way of an example. The diagrams illustrate only the principles of the invention and how these principles are embodied in various fields of application. It is however to be understood that the purely diagrammatic showing does not offer a survey of other possible constructions and a departure from the constructional features diagrammatically illustrated does not necessarily imply a departure from the principles of the invention. It is therefore to be understood that the invention is capable of numerous modifications and variations apparent to those skilled in the art without departing from the spirit and scope of the invention.

In the accompanying drawings, forming part hereof, similar reference characters designate corresponding parts.

FIG. 7 is a horizontal cross-sectional plan view taken along line 7—7, showing slots on the outlet port regulating and forward rotation limiting means; also showing a slot on lower side rotor plate for regulating transfer of gases from the combustion chambers to pressure chambers.

FIG. 8 is a horizontal cross-sectional plan view taken along line 8—8 of FIG. 1, showing holes on the lower base of the housing for processing exhaust gases.

FIG. 9 is a table showing which stroke is performed during each stroke time interval and the orientation of the slot on the center rotor, communicating the chambers of the upper and lower engine which are in the same stroke.

FIG. 10 is a schematic block diagram illustrating an overall efficient engine operating in combination with a dynamic braking arrangement and a pressure tank.

DETAILED DESCRIPTION OF THE PREFERRED EMBODIMENT

Figure 1:
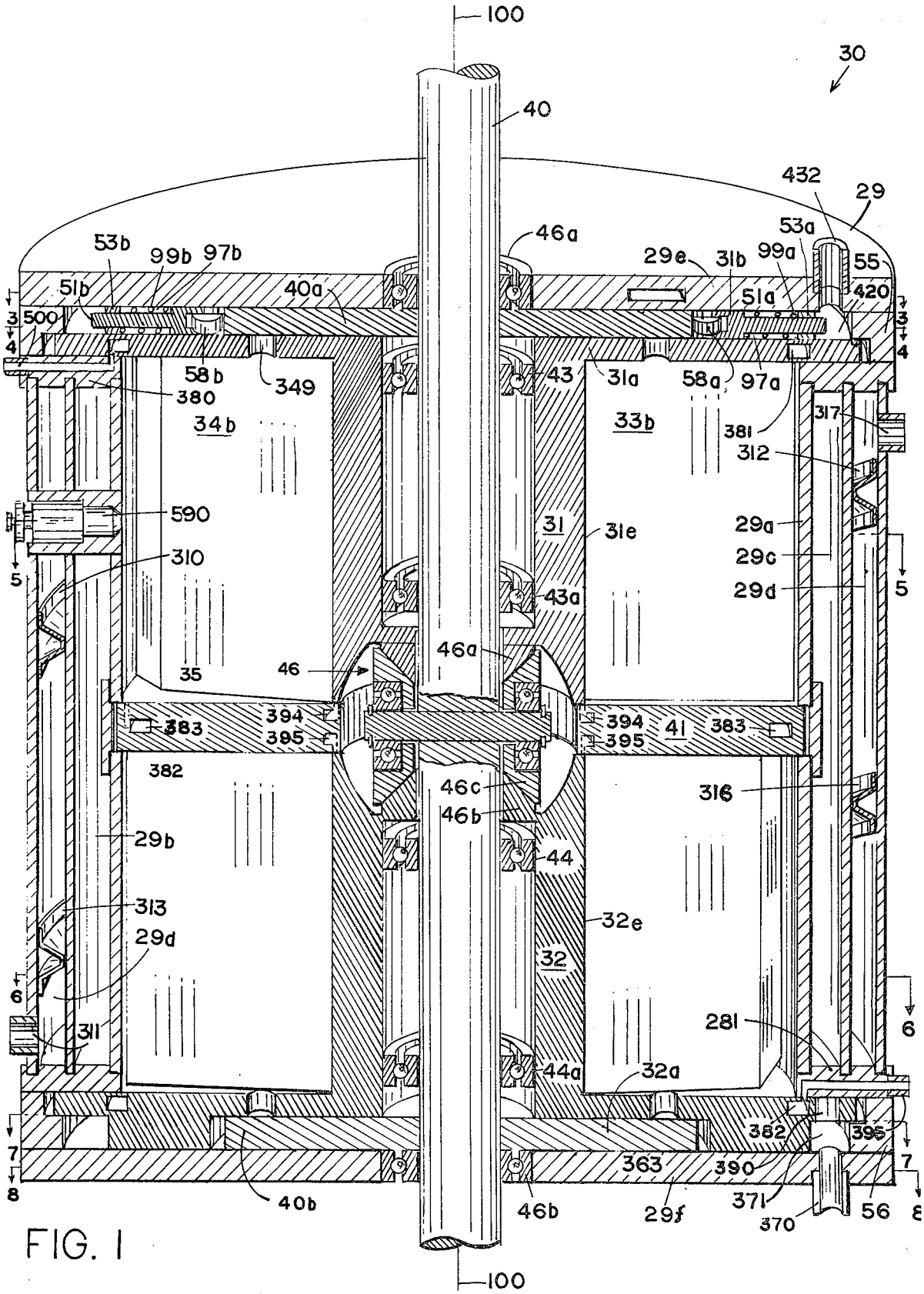
FIG. 1 is an external, partially schematic, perspective view of an engine constructed in accordance with the features of the present invention, with portions of the external housing broken away and the center portion of the engine cross-sectionalized for ease of illustrating the invention.

The engine covered by the invention is based on principles which will be best understood by referring to FIGS. 1 to 9. Referring now to FIG. 1, there is shown an engine 30 for illustrating the preferred characteristics incorporated herein in accordance with the principles of the invention.

Housing and Center Shaft

A main housing 29 is shown to have a cylindrical shape about a vertical axis 100—100, comprising a cylindrical side **29*a* and bounded by circular bases 29*e* and 29*f*. A center shaft 40 is rotatably supported on the housing by bearings 46*a* and 46*b***.

Rotors and Differential Gear Assembly

On the center shaft 40 there are rotatably supported two side rotors, a top side rotor 31 supported by two bearings 43 and **43*a* and a lower side rotor 32 supported on the shaft 40 by two bearings 44 and 44*a*. A third rotor 41 is securely attached to the shaft 40, preferably with key slot and wedge. The center shaft from now on therefore will be considered to be part of the third rotor 41. The three rotors 31, 32, and 41 revolve about the axis 100—100 with three bevel gears 46*a*, 46*b*, and 46*c*, respectively of a differential assembly 46 comprising an upper side gear 46*a*, a lower side gear 46*b* and a center gear 46*c*. The differential gear assembly 46 causes the rotation of the center shaft 40 and the rotor 41 with respect to the housing 29 to be equal to the average rotation of the rotors 31 and 32 with respect to the housing 29**.

Cavity of Revolution of Genus 1

As in the case of the Two Rotor Engine, the present invention provides a cavity of revolution 35 which topologically is described as being of genus 1. This type of cavity and methods of generating such cavity have been described in said patent application in the section CAVITY OF REVOLUTION OF GENUS 1 where the reasons for choosing a rectangle as the generating closed curve about the axis 100—100 to form the cavity of revolution have also been explained. In the present invention such a cavity of revolution is formed by surfaces provided by at least the third rotor 41 and one of the side rotors, either 31 or 32. The inside side surface 29a of the housing 29 may make up part of the cavity of revolution 35 as is shown in the preferred embodiment in FIG. 1. It may easily be seen from FIG. 1 that a cylindrical wall extending from the rotor 41 parallel to the side cylindrical wall 29*a* of the housing can be used instead of housing. In fact the cylindrical wall 29*a* may be attached to and revolve with the rotor 41 or the side rotor 31 instead of being stationary and part of the housing 29. The advantage of the wall 29 being stationary is easier servicing of spark plugs when used with the engine. It is also possible for the cavity of revolution to be formed next to the shaft 40 by expanding the cavity of revolution containing the bearings 43 and 43*a* in FIG. 1, with the surface of the shaft 40, itself providing part of the cavity of revolution.

Chambers and Diaphragms

Figure 2:
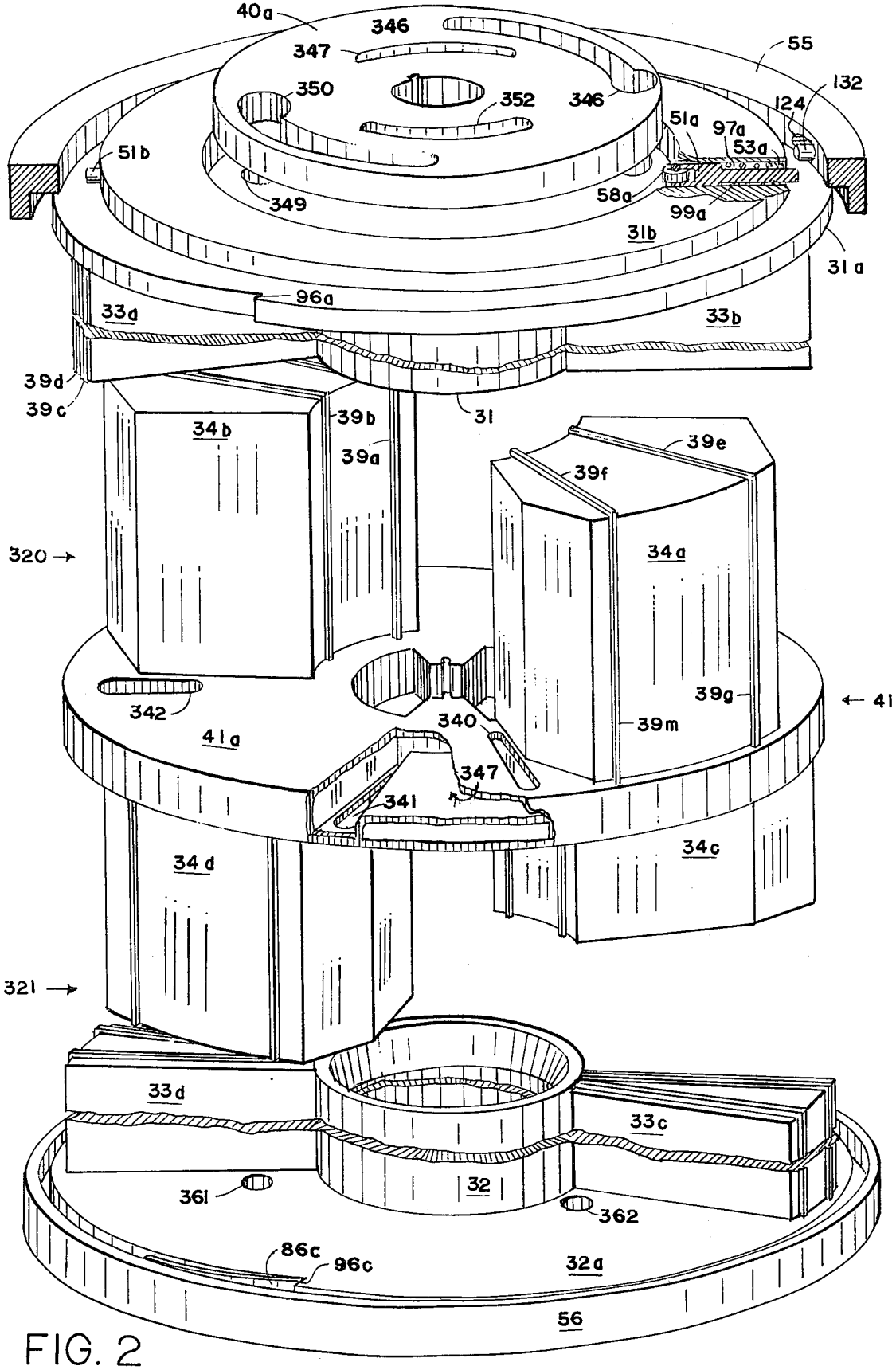
FIG. 2 is a perspective exploded view of the three rotors, with housing and center shaft removed. The side rotors and their diaphragms are fractionalized to appear shorter in the illustration, thus allowing adequate view of the center rotor and its diaphragms.
Figure 3:
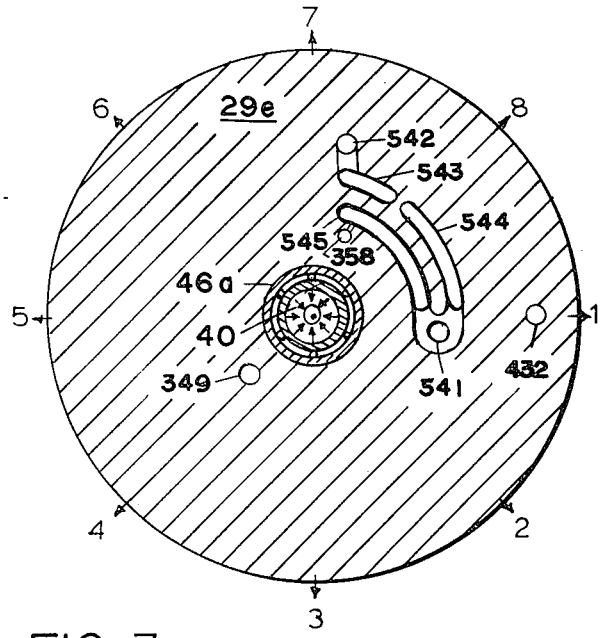
FIG. 3 is a horizontal cross-sectional plan view taken along line 3—3 of FIG. 1, showing channels, slots and holes in the top base of the housing, for regulating the timing for the entrance of various gases in the combustion chambers.

The diaphragms in the Three-Rotor Engine perform the same function as in the Two-Rotor Engine. They separate the cavity of revolution rotatably about the axis into $2n$ chambers, $n$ being the number of diaphragms attached to each rotor. Each chamber is bounded by the wall of the cavity of revolution and by one diaphragm from each of two rotors. When the two rotors are forced to rotate with respect to each other, half of the chambers expand while the other chambers contract in volume. What is known as compression ratio in engines is the ratio of the largest to the smallest volume that each chamber can assume. The number of diaphragms per rotor per engine depends on the number of strokes required in the particular cycle which is to be performed. When more than one engine is using the same center shaft and associated gears, the engines in which the center rotor and a third rotor provide one set of diaphragms must use twice the number of diaphragms than the engine where diaphragms are provided by the two side rotors. An exploded perspective view of the rotors and the diaphragms attached to them in the preferred embodiment is shown in FIG. 2. The center rotor 41 provides diaphragms to two engines, an upper engine 320 and a lower engine 321 separated by a common circular plate 41*a*.

Considering the upper engine 320 in FIG. 2, each rotor is shown to provide two diaphragms. The center rotor 41 has attached to it the diaphragms 34*a* and 34*b*, interleaved with diaphragms 33*a* and 33*b* attached to the rotor 31. It should be noted that in the Three-Rotor Engine it is not necessary for the two sets of diaphragms to have the same inertial mass; therefore in the preferred embodiment most of the mass is thrown into the diaphragms 34*a* and 34*b* attached to the center rotor 41 where their mass can serve as a fly-wheel, while the size of the diaphragms 33*a* and 33*b* is kept as small as possible for fast acceleration and deceleration.

In the preferred embodiment as shown in FIG. 1, the cavity of revolution of the upper engine has its side towards the axis contributed by the cylindrical portion of rotor 31, its top side is contributed by the plate 31*a* of rotor 31, the lower side is contributed by the center rotor 41 and the fourth side is contributed by the housing, for ease of servicing of the one spark-plug needed.

In FIG. 2 each diaphragm is shown to have a pair of sealing elements along each side which is in sliding contact with another surface. It is shown later that a lubrication system can be provided where lubricating oil flows in the channel formed by the pair of sealing elements, the surface of the diaphragm and the surface on which the diaphragm is sliding. In particular the diaphragm 34*a* in FIG. 2 is shown to have sealing elements 39*f*, 39*e*, 39*g*, and 39*m* and two more sealing elements not shown. The purpose and design of the sealing elements has been discussed in detail in said patent application and no additional information need be added here.

Figure 5:
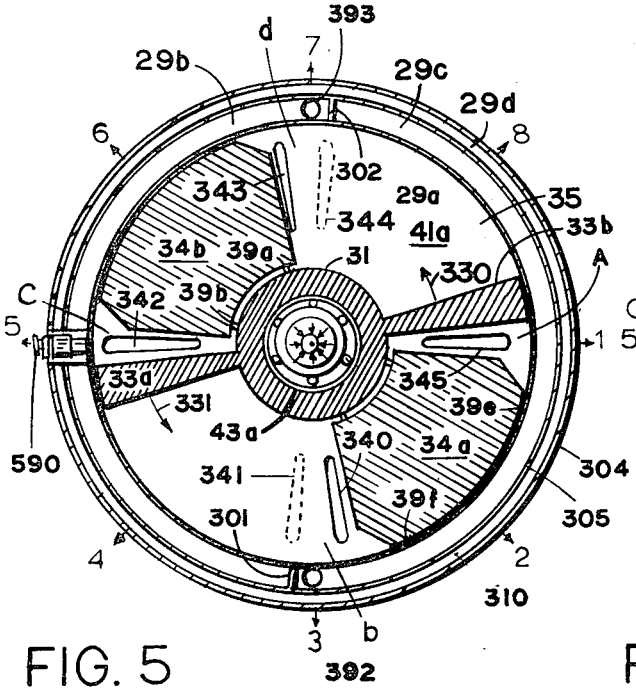
FIG. 5 is a horizontal cross-sectional plan view taken along line 5—5 of FIG. 1, showing the parts of the top side rotor and center rotor and their diaphragms operating in the upper engine; also showing slots for pressure communication of the chambers of the upper engine with the chambers of the lower engine, and pressure and heat exchanger chambers in the housing of the engine.
Figure 6:
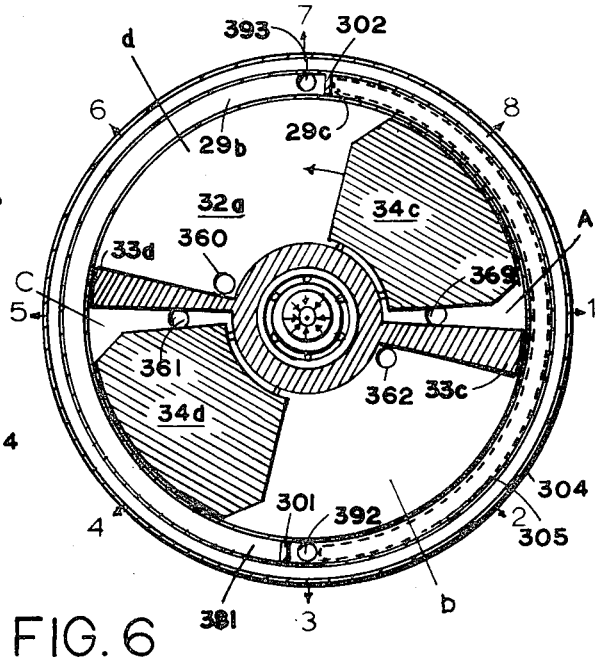
FIG. 6 is a horizontal cross-sectional plan view taken along line 6—6 of FIG. 1, showing the parts of the lower side rotor and center rotor and their diaphragms operating in the lower engine; also showing pressure and heat exchanger chambers in the housing of the engine.

The relative rotational position of the diaphragms of the upper engine is also shown in FIG. 5. Where sliding occurs between a diaphragm and a surface of the cavity 35, sealing elements are shown. In particular sealing between the diaphragm 34*b* and the rotor 31 is shown to be accomplished by the sealing elements 39*a* and 39*b*.

The diaphragms 33*a*, 33*b*, 34*a*, and 34*b* divide the cavity of revolution 35 into four chambers each of which is assigned during the first stroke time interval a particular stroke. Let the four chambers in FIG. 5 be assigned the strokes A,*b*, C,*d* of a particular cycle, as shown, in the clockwise direction. The stroke pattern as was the case in the Two-Rotor Engine, will move in the opposite direction which in this case is the counterclockwise direction.

In said patent application I had considered the clockwise direction as the forward direction. In the present application, the counterclockwise direction will be considered to be the forward direction shown by the arrow 330, and this will be the only rotational direction in which any of the rotors will be allowed to rotate. In the reverse direction the side rotors are allowed to rotate only through a limited angle before they are stopped by the reverse motion limiting means.

Rotation of the diaphragms in the Three-Rotor Engine's case is different than in the case of the Two-Rotor Engine. In the present invention, both sets of diaphragms rotate in a cavity, but the set of diaphragms, such as 33*a* and 33*b*, belonging to a side rotor such as 31, rotates twice as fast as the set of diaphragms belonging to the center rotor 41. The amount of rotation of the center rotor 41 per stroke-time interval is $180/n$. While the rotation of a side rotor is $360/n$, $n$ being the number of diaphragms per rotor. Another difference is that while in the case of the Two-Rotor engine, we were able to denote a chamber by a single radial plane, in the case of the Three-Rotor Engine, a chamber must be denoted by a whole sector of an angle $180/n$.

Referring now in particular to FIG. 5 and assuming we are at the beginning of the first stroke-time interval, the rotor 31 with diaphragms 33*a* and 33*b* will rotate in the forward direction shown by the arrow 330, an angle of 180° with respect to the housing. The rotor 41, with diaphragms 34*a* and 34*b*, will also rotate in the same rotational direction shown by the arrow 330, but at half the angular velocity of the rotor 31. Effectively the volume of each chamber will change by $180/n$, which is the same amount as in the case of the Two-Rotor Engine. What is difficult to comprehend in the Three-Rotor Engine is that the detonation of the fuel in the cavity starting at plane 0–5 is forcing the rotor 34*b* and therefore the center rotor 41 in the reverse direction while it is caused to move in the forward direction. The reason it works is that the rotor 33 is forced in the forward direction. Since there is a 2:1 gear advantage between rotor 31 and rotor 41, as a consequence of the differential assembly, the rotor 41 is pushed with twice as much force in the forward direction and therefore with the full force of the pressure of the combustion chamber in the forward direction. During this time the second side rotor 32 is forced with equal force in the reverse direction but its reverse rotation is limited by the arrangement of the pawl 86*c* operating with ratchet 96*c* shown in FIG. 2.

During the second stroke-time interval, the chamber which now may be denoted by the plane 3, now in stroke *b*, for compression, will be in power stroke *c*. The rotor 31 will be forced in the reverse direction and will be stopped by a pawl 86*a* holding against a ratchet step 96*a;* while the rotor 41 will receive full force in the forward direction. The rotor 32 will rotate 180° free in the forward direction. We see therefore that alternately one of the rotors 31 and 32 is forced in the forward direction while the other is forced in the reverse direction. The latter is decelerated and is prevented from rotating by reverse motion limiting means, thereby causing the center shaft to rotate at approximately constant speed in the forward direction. The resulting output torque therefore in the present arrangement is half what we had in the Two-Rotor Engine, but at twice the speed. Therefore the output power P=TxW, the product of torque and angular velocity remains the same in the two types of engines.

Rotation Limiting Means

While in the present configuration, only one of the two side rotors provides diaphragms in the cavity of revolution, each side rotor is decelerated to a stop during the next stroke-time interval. The center rotor keeps approximatey uniform speed, rotating with the average speed of two rotors, where one rotor is being accelerated from zero speed, providing an angular velocity of $W_1=0+at$ to the differential gears, the other rotor being decelerated from a maximum angular velocity of $W_0$ to a velocity $W_2=W_0-at$, where $a$ is the angular acceleration and $t$ is the time in any stroke interval. The angular velocity of the center rotor will be $W=(W_1+W_2)/2=(0+at+W_0-at)/2=W_0/2$ which is not dependent on time $t$ and therefore is a constant. In this argument, I have assumed the same rate of acceleration and deceleration for both side rotors. This condition will be satisfied when the moment of inertia in both side rotors will be same. This implies that when the Three-Rotor Engine is being applied as a single engine with only one of the side rotors providing diaphragms and the other rotor idling, rotational inertia can be added to the latter to equalize the amount of inertia contributed by the diaphragms of the former rotor, for keeping the angular velocity of the center rotor substantially constant.

It should be noted that each side rotor must provide rotation-limiting means whether it contributes diaphragms to a cavity of revolution or not. As in the case of the said patent application, there are two types of rotation limiting means needed: the reverse rotation limiting means and the forward rotation limiting means.

Figure 4:
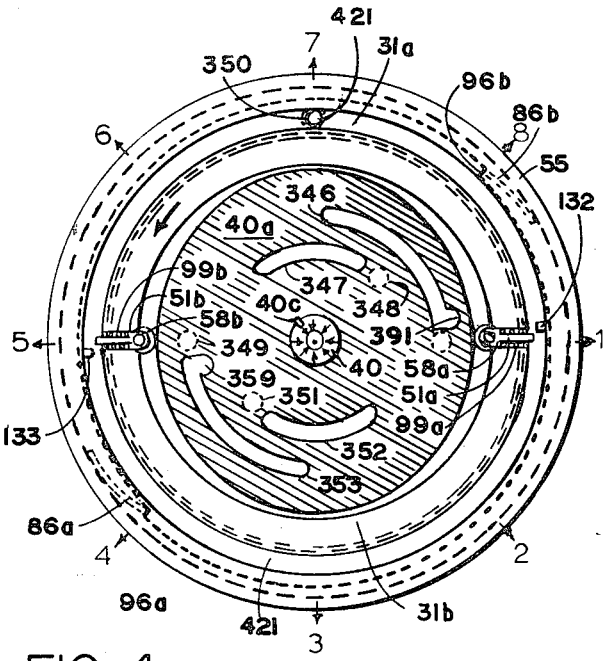
FIG. 4 is a horizontal cross-sectional plan view taken along line 4—4 of FIG. 4, showing the intake regulating plate, rotation limiting means, and a pressure chamber outlet hole.

A preferred design of reverse rotation limiting means involves pawls and ratchet step arrangements. Two circumferential rings 55 and 56, as shown in FIGS. 1, 2, 4, and 7, are securely fastened onto the housing of the engine. The rings 55 and 56 provide pawls in the form of spring blades extending tangentially from the ring toward the ratchet steps provided along the edge of a round plate extending from each side rotor towards the aforesaid rings. In particular, FIGS. 1, 2, and 4 show a round plate 31*a* extending from the rotor 31 towards the ring 55. The plate 31*a* provides ratchet steps 96*a* and 96*b*. The ring 55 provides pawls 86*a* and 86*b* which permit the rotor 31 to rotate in the forward direction but limit its reverse rotation beyond the ratchet steps as the pawls engage with the ratchet. At least one pair of pawls and ratchet steps are shown symmetrically disposed with respect to the axis to form a pair of forces resulting in pure azimouthal forces and contributing to no radial forces which could increase friction. Similarly, the rotor 32 provides a ratchet such as 96*c* on a plate 32*a* revolving inside a ring 56, the latter being securely attached to the housing 29 and providing pawls such as a pawl 86*c* shown in FIG. 2. Such arrangement of pawls and ratchet prevents the rotor 32 from rotating in the reverse direction further than the point where the pawls engage with the ratchet. Again, preferbly at least one symmetric pair of pawls is provided by the ring 56. The pawls are chosen in the form of spring blades to provide the capability of flexure under force, thus providing spring loading capability to preclude sudden stop of the rotor, and in turn, precluding the transmittal of sharp impulses of force to the center rotor.

As it has been in the case of the Two-Rotor Engine in said patent application, the forward rotation limiting means in the present configuration is also needed during starting of the engine, during misfiring, and when the configuration is used as a pump. During these instances, forward torque is provided to the rotors of the engine through the center rotor forcing both side rotors equally in the forward direction. The forward rotation limiting means alternately stops one, then the other, of the side rotors when it reaches a maximum forward allowable rotation. The rotor is stopped for the duration of a full stroke-time interval, so that only one of the side rotors is permitted to execute forward steps during each stroke-time interval. Each of the side rotors must provide a forward as well as a reverse rotation limiting means regardless of whether the unit involves: (1) a single cavity of revolution in which case, only one of the side rotors provides diaphragms in the cavity of revolution; (2) two cavities of revolution with each of the side rotors providing diaphragms; or (3) more than two cavities of revolution in which case a side rotor may provide diaphragms to more than one cavity of revolution.

In the preferred embodiment the forward rotation limiting means are shown in FIGS. 1, 2, 4, and 7. A radially adjustable sliding bolt 51*a* is supported on an extention 31*b* of the rotor 31 circumferentially disposed about a plate 40*a* having substantially an elliptical shape and securely supported on the shaft 40 by a key and wedge arrangement 40*c*, as best shown in FIG. 4. Referring now to FIGS. 1, 2, and 4, a step 97*a* in the size of the bolt 51*a* permits spring loading of the bolt 51*a* by a spring 99*a*. A bushing 53*a* blocking the opening is rigidly fastened onto the plate 31*b* for retaining the spring 99*a* into the step 97*a*. The spring 99*a* therefore exerts a force on the bolt 51*a* towards the edge of the ellipsoidal plate 40*a*. Preferably a roller 58*a* will be provided on the bolt 51*a* for reducing friction between the bolt and the edge of the plate 40*a*. When the short dimension of the ellipsoidal plate 40*a* is in line with the bolt 51*a*, the bolt is retracted towards the plate plate 40*a* so that the outer end of the bolt 51*a* does not meet a post 132 protruding from the ring 55. The rotor 31 than can rotate 180° forward while the plate 40*a* will rotate 90°, therefore then presenting the long dimension of the ellipse in line with the bolt so that further excursion of the rotor 31 will be stopped by a protrusion such as 133. During the following stroke-time interval, then, the rotor 31 will remain stationary while the plate 40*a* will rotate 90° so that during each odd stroke-time interval the rotor 31 will be released to rotate 180°. A pair of such bolts 51*a* and 51*b* are used operating in conjunction with a pair of protrusions 132 and 133 for the purpose of precluding radial forces. The protrusions such as 132 may be spring-loaded with respect to the ring 55 operating in a slot 124 shown in FIG. 2.

A similar arrangement is provided in the rotor 32 with bolts 51*c* and 51*d* operating in conjunction with springs 99*c* and 99*d*, rollers 58*c* and 58*d*, and protrusions 133 and 134 as shown in FIG. 7.

It should be noted that during normal engine operation, it is the reverse-directed pressure which decelerates the rotor and causes the rotor to be stopped by the pawl and ratchet arrangement rather than the bolt and protrusion arrangement. But when the configuration is used as a pump alone, then it is the bolt protrusion arrangements which determine which rotor is allowed to rotate.

Chambers, Cycles and Strokes

As is true in the Two-Rotor Engine of said patent application, the Three-Rotor Engine also has an even number of chambers. This is true because two rotors contribute diaphragms of equal number each; therefore the total number of diaphragms is always even. As the two sets of diaphragms are forced to rotate with respect to each other, the volume of half the chambers expands while the volume of the other chambers contracts. The configuration therefore is applied to perform cycles which contain two or a higher even number of strokes. For example, applications such as a pump, a fluid meter, a steam engine, a hydrostatic pressure engine, and external combustion applications including geothermal applications as well as some gasoline and Diesel fuel engines, can operate in two cycles. The Three-Rotor Engine may be applied in the design of any of these engines. When more than one diaphragm is contributed by each of two rotors per cavity of revolution, the chambers are divided in groups, each group including two chambers, one chamber expanding while the other is contracting in volume. The number of diaphragms per rotor provides an effective step-up in torque output. Let us assume we apply the Three-Rotor Engine to two hydrostatic power plants, one operating with one diaphragm per rotor, the other *n* diaphragms per rotor, and both operated under the same hydrostatic pressure. Both engines during the first stroke-time interval will intake equal amounts of water, and therefore equal energy. The engine with the one diaphragm per rotor will provide 180° rotation in the output shaft and torque T. While the engine with *n* diaphragms will provide a rotation of only 180/*n* degrees but a torque equal to *n*xT. The total amount of work done by either engine will be the same, as expected. It should be noted, however, that the duration of the strokes will be different by a factor of *n;* therefore the engine with *n* diaphragms per rotor will intake *n* times the amount of water per hour, and therefore will be a more efficient engine in that respect. The same reasoning applies to advantage in the case where the Three-Rotor Engine is applied to be driven by geothermal hot gases, which may be abundant but at relatively low pressure. A high value of *n* will increase the output torque and the amount of pressurized gas being processed. Also in the case where the configuration of the Three-Rotor Engine is applied to a pump, the higher the value of *n* the greater the amount of the fluid pumped. An instance where this can be used to advantage is in the case where the pump is to be used as a means for converting kinetic energy into air pressure in a dynamic braking arrangement. A high value of kinetic energy can be converted into potential energy by increasing the coupling of the drive shaft with the input shaft of a pump built in accordance with the Two-Rotor or the Three-Rotor configuration and having a high *n*, pumping outside air into a pressure tank.

In said patent application, I showed that complex multi-stroke thermodynamic cycles can be performed where an adequate number of chambers are provided by an adequate number of diaphragms per rotor. The complex cycles described in said patent application involve strokes such as:

The four strokes used in the Otto cycle:

1. Intake of carborated mixture
2. Compression of the carborated mixture
3. Detonation of the carborated mixture and power
4. Exhaust of the burned gases They also involve several novel strokes as follows:

1. A power stroke where after detonation of the carborated mixture in one chamber, expansion is taking place in two chambers, with the second chamber containing no air, for reducing the temperature of the detonated mixture.

2. Simultaneous compression of two chambers, one containing fresh air, the other the gases after first detonation. This is for increasing the temperature of the air by further burning of the hydrocarbons and therefore conversion of CO to $CO_2$ and by transfer of heat from the walls of the chambers and the hot gases to the air.

3. Expansion of the chambers in case (2) whereby the increased pressure can provide torque 4. Executing dummy Otto cycles involving four strokes, as in the case of the Otto cycle, but using fresh air instead of a carborated mixture of air.

This is for cooling the engine and for converting some heat entrapped in the internal walls of the engine into torque.

These strokes are equally adaptable to the Three-Rotor Engine as they are to the Two-Rotor Engine.

Pressure Chambers

I now will introduce a new method for converting heat into torque, not covered in said patent application. This is a method which can be applied in combination with other engines as well, such as the piston engines or the Wankel Engine. But the configurations of the Two-Rotor and the Three-Rotor Engine can be used more effectively in conjunction with this method. This method provides that in combination with the variable volume chambers of an engine, we have fixed volume-pressure chambers, where relatively cool air can be heated up by being kept in the chamber over a relatively long time, its increased pressure then being communicated into an expanding variable volume chamber of the engine, thereby converting heat into torque. The pressure chambers are preferably to be built around the housing of the engine, next to the combustion chambers so that heat conducted through the housing wall can be used to heat up the pressure chambers. Another source for the heat needed to heat up the air in the pressure chambers is the hot exhaust gases. These hot gases can provide heat to the pressure chambers while being forced to flow along the outside wall of the pressure chambers. Another method shown in the preferred embodiment of the present application provides for the hot products of a first burning of hydrocarbons to be transferred into a pressure chamber where relativey cool air is added. The mixture remains in the pressure chamber for a predetermined number of strokes at which time it is returned to a variable volume chamber for reprocessing. The amount of cooling to be provided to the engine can thus be controlled by the amount of air introduced into the pressure chambers, and also by processing air through dummy Otto cycles.

I will now demonstrate how the method of using fixed-volume pressure chambers can be used to advantage in combination with a Three-Rotor Engine in the preferred embodiment.

The fixed-volume pressure chambers 29*b* and 29*c* are shown in FIG. 5 built inside the side portion of the housing 29 and separated by walls 301 and 302. An additional wall 304 external to the pressure chambers 29*b* and 29*c* is provided to guide the exhaust gases around the pressure chambers 29*b* and 29*c*. This is for additional transfer of heat from the exhaust gases into the gas contained in the pressure chambers just prior to being dumped into the atmosphere. The exhaust gases enter the space 29*f* through an inlet 311 and spiral around the pressure chambers to the outlet 317 inside a duct formed by the walls 304 and 305 and a strip 310 helically disposed inside the space 29*d*. The helical duct helps increase the time of interaction between the exhaust gases and the wall 305 of the pressure chamber, thereby increasing the heat transfer between exhaust gases and pressure chamber.

The Overall Efficient Car Engine

The preferred embodiment illustrates an example of an engine which can provide the basic design of an overall efficient power plant to a car. For an engine to be overall efficient it must be capable of reducing waste in several respects, as for example in the following ways:

1. Having a good thermal efficiency (Torque x angular shaft displacement per unit of fuel). Recovery of heat now being wasted in the cooling system and the hot exhaust can substantially increase thermal efficiency.
2. Contributing low weight to the car since weight contributes to frictional losses in terms of the extent of tire deformation as the car moves. Eliminating the cooling system will substantially reduce the weight of the power plant.
3. Occupying small volume so that the size and therefore the weight of the part of the car containing the engine can be kept low; while the car can be optimally shaped and aerodynamically streamlined to reduce air frictional losses.
4. Utilizing a low power unit for normal driving but being capable of providing increased torque for short intervals.
5. Providing dynamic braking for recovery of the kinetic energy lost in the braking system, especially during stop-and-go heavy traffic.
6. Provide stratification of charge to preclude excessive fuel consumption and for reducing the amount of pollutants.

The FIGS. 1 through 9 illustrate an example of such overall efficient power plant. The configuration of the Three-Rotor Engine has been chosen because it can provide the aforementioned capabilities more effectively than other power plants. The preferred embodiment incorporates two engines working in unison in a single unit. FIG. 2 shows the rotors and diaphragm of an upper engine 320 and a lower engine 321. The upper engine 320 is formed by diaphragms 33*a* and 33*b* contributed by the upper side rotor 31 and by diaphragms 34*a* and 34*b* contributed by the center rotor 41 into a cavity of revolution formed by the rotor 31, the center rotor 41 and the housing 29*a*. The lower engine 321 is formed by diaphragms 33*c* and 33*d* contributed by the lower side rotor 32 and by diaphragms 34*c* and 34*d* contributed by the center rotor 41, into a cavity of revolution formed by the rotor 32, the center rotor 41, and the housing 29*a*. With two diaphragms per rotor in each cavity, there are four variable volume chambers in each engine, therefore a total of eight chambers in the two engines. However, in the preferred embodiment, each of the chambers in the upper engine communicates with the one chamber of the lower engine through slots such as 340, 342, 343, and 345. The slots 342 and 345 are shown going vertically through the plate 41 providing direct communication between cavities of the upper and lower engine. The upper slots 340 and 343 communicate with lower slots 341 and 344, respectively, through tunnels such as tunnel 347. Both engines 320 and 321 use the same rotation limiting means provided by the rotors 31 and 32 and already described in conjunction with the upper engine 320, so that the addition of the second engine 321 does not require separate rotation limiting means.

Lubricating Means

The present invention provides the capability of oil lubrication. Referring to FIG. 1, the oil enters the engine through an inlet 500 on the top cover of the pressure chambers 380. Next the oil is communicated to a circular tunnel 381 which feeds the ducts between the sealing elements of the diaphragms of the upper side rotor, thus bringing the lubricating oil to a circular tunnel 394 in the center rotor. From the tunnel 394, the oil travels outwards between the sealing elements of the two diaphragms 34*a* and 34*b* to a second circular tunnel 383 also in the center rotor. Next, the lower diaphragms of the center rotor are serviced whereby the lubricating oil reaches a third circular tunnel 395 also in the center rotor. Finally, the lubricating oil travels between the sealing elements of the lower rotor ending into a circular tunnel 382 and from there into the oil outlet 395.

The Overall Efficient Cycle

The cycle in which the overall efficient engine of the preferred embodiment operates is shown in FIG. 9. Strokes shown over the diagonals are executed by chambers of the upper engine; those shown under the diagonals are executed by chambers of the lower engine. The first column on the left entitled "PLANES" indicates the planes swept by a particular slot, such as a slot 340, 342, 343, or 345, which brings in communication the two corresponding chambers, one in the upper engine, the other in the lower engine, executing the same stroke during a particular stroke-time interval. The table shown in FIG. 9 has been compiled on the general basis that all diaphragms have the same angular width each approximately 45°. As shown in FIG. 5, about 30° of the angular width has been shifted from the diaphragm 33*a* and 33*b* to 34*a* and 34*b*, respectively. This has been done to show that most of the mass of the diaphragms can be thrown into the diaphragms of the center rotor where they can act as a fly-wheel, while at the same time, reducing the inertial mass of the side rotors. In doing so, the position of the slots 340 and 343 has been rotated clockwise with respect to the housing, by an equal angle, about 30° in this case. In FIG. 9, the chambers denoted by such displaced slots are shown in low case letters. Therefore as far as the strokes represented in FIG. 5 by low case letters are concerned, the plane shown on the left column should be adjusted by about 30° counterclockwise. For example, the stroke *b* during the first stroke-time interval executed by the chambers containing the slot 340 is shown in FIG. 9 to sweep planes 2–8 corresponding to an angle −45° to +45° with the reference 0° angle being at radial plane 1. Because of the said displacement of the slot 340, the actual angle swept with respect to the housing by the slot 340, representing these two chambers in stroke *b*, is −75° to +15° with respect to the radial plane 0–1 which corresponds to 0°. The planes 1–7, representing stroke A, are not so adjusted since the slot 345 has not been displaced in the process of shifting angular width from the diaphragms of the side rotors to the diaphragms of the center rotor.

The overall efficiency cycle of the preferred embodiment will now be described in detail. It consists of four sets of four strokes, each set resembling an Otto cycle, designated in FIG. 9 by ABCD (bold), *abcd* (bold), ABCD (light), and *abcd* (light). The capital bold letters ABCD in FIG. 9 represent the four strokes of a modified Otto cycle. During a substantial part of Stroke A, the chamber which is sweeping planes 1–7 receives air through the coincidance of a sidecut 391 of the slot 346 in the plate 40*a* and a channel 544, cut on the lower side of the top base 29*e* shown in FIG. 4. The channel 544 receives air, preferably pressurized, from a pressure tank 411 through an inlet inlet 341 shown in FIG. 3. The two cavities, one in the upper engine 320, the other in the lower engine 321, intake pressurized air. Later in the cycle, the side cut 391 overcomes the channel 544 and takes fuel from the channel 543, which receives such fuel from the inlet 542 shown in FIG. 3. As the fuel must pass through the chamber of the upper engine before it reaches the chamber of the lower engine, most of the fuel will remain in the upper chamber. With the fuel so stratified, the concentration in the upper chamber will be much higher than in the lower chamber. Detonation during the following stroke C therefore can take place in the upper chamber with the expansion extending to both upper and lower chambers, at much leaner average mixtures. This method thus precludes excessive feeding of fuel into the combustion chambers for the sole purpose of maintaining sufficiently high concentrations for ignition, as is the case in most conventional engines. This method also helps shorten the time of elevated temperatures, thus cutting down the generation of $NO_x$ pollutants. During stroke D the gaseous products of the first burning are being compressed into the pressure chamber 29*c* during the fourth stroke-time interval. This is accomplished by the coincidence of the opening 361 on the plate 32*a*, shown in FIG. 6, with a slot 363 shown in FIG. 7 and an outlet 368 shown in FIG. 8. The outlet 368 is connected directly to an inlet 370, which communicates with a channel 371 formed between the rotor 32*a* and the housing 29. The said products of the first burning are further communicated to the pressure chamber 29*c* while a slot 390 on the plate 32*a* is in coincidence with a hole 392 on a cover plate 281, covering the lower side of the pressure chambers. The pressure chamber 29*c* has received a shot of cold pressurized air from a pressure tank 411 through an inlet such as 432 shown in FIG. 10, during the previous stroke-time interval. This can be done by a relatively simple air distributor 430 directly driven by the shaft 40 of the engine for establishing communication of the pressure of the pressure tank 411 and the pressure chambers 29*b* and 29*c*.

The mixture of hot products of the first burning and the cool air will remain in the pressure chamber during the entire next full stroke-time interval. During this time, the hot gases and the cool air are expected to come to near temperature equilibrium. The temperature of the mixture will further be increased by heat conducted through the walls of the pressure chambers arriving from the combustion chambers and from the helical duct guiding the final exhaust gases to the atmosphere. The pressure chamber 29*c* is then communicated back to the varible volume chambers where the strokes *a b c d*, shown in bold letters in FIG. 9, are being executed.

During the stroke *a*, executed in the 6th stroke-time interval, (the same as shown in the interval 2 in FIG. 9), the mixture of one time burned gases and air is returned to a variable volume chamber, as the hole 350, on the plate 31a, shown in FIG. 4 will remain in coincidance with hole 421 on the upper cover 380 of the pressure chambers. From the circular channel 420, the gas mixture is being communicated through the outlet 432 to an inlet 340 shown in FIG. 3. The mixture then reaches the appropriate chamber during coincidance of the hole 340, a hole 351 on the plate 31*a*, and a slot 347 on the plate 40*a* shown in FIG. 4. The mixture entering the chamber is being processed by a full 4 stroke sub-cycle shown in FIG. 9 by low case bold letters. During stroke *b*, the mixture is being recompressed, while absorbing heat from the walls of the chamber. With its temperature and pressure being raised unburned hydrocarbons such as CO will burn towards $CO_2$ with the additional heat generated accelerating the process and further raising the gaseous pressure, which then, during the following stroke *c* (bold), can be converted into useful torque. During strokes *d*, outlet 367 connects with inlet 311. During the following set of four strokes ABCD (light) a side cut 359, FIG. 4, sweeps against a channel 345, introducing only air. The following eight strokes, ABC- D*abcd*(light) therefore will be identical to the previous eight strokes ABCD*abcd*(bold), described above, except that normally no fuel is being introduced into the engine. These eight strokes constitute two dummy Otto cycles which will serve to cool the engine and convert some of the heat to useful torque. When emergency acceleration is needed a special inlet 358 will inject fuel into the air arriving from the inlet 341 shown in FIG. 3, so that a regular ABCD*abcd*(bold) sequence of strokes will occur providing the required additional torque.

Pressure Tank and Dynamic Braking

The FIG. 10 shows an overall efficiency engine 30 in combination with a pressure tank 411 and a high torque pump 410. The pressure tank 411 is used for providing pressurized air to the complex cycle described above. The energy in the system is conserved and any pressure introduced from the pressure tank either in the pressure chambers or the variable chambers is eventually being converted into torque. Work will be needed to maintain a minimum air pressure in the pressure tank 411. This pressure can be obtained from two pumps using the Three-Rotor configuration, with each rotor also having two diaphragms to be built in the spaces next to the center shaft 40 between pairs of bearings 43 and 43*a* and 44 and 44*a*, widened radially to the needed size. Port control for the upper pump, for example, can be accomplished through holes on the housing base 29*e* and the rotor plate 31*a* and slots in the plate 40*a* next to the slots 347 and 352 towards the axis. Neither the aforesaid two pumps nor associated slots are shown in the drawings. The pressure from such pumps can be communicated to the pressure tank 411 through a path indicated by the arrow 405. The release unit 442 shown in FIG. 10, amounts to a valve which opens the line arriving from the aforesaid two pumps to the atmosphere when the pressure in the tank reaches a predetermined value. In this condition the two pumps will intake air from the atmosphere and will dump same air back into the atmosphere without performing any work. For tank pressures lower than the predetermined pressure, the two pumps will do work by pumping air into the pressure tank, thereby storing potential energy.

During stop-and-go, heavy traffic and during downhill driving, the dynamic breaking arrangement shown in FIG. 10 can provide pressure to the tank 411 from a high torque pump 410. The brakes here can operate a variable shaft coupler 409 which effectively reduces the slippage between two shafts. One of the shafts is connected to the drive shaft, the other can be the center shaft of a Two-Rotor or a Three-Rotor Pump 410, with a large number of diaphragms per rotor so that it can process considerable air very fast and therefore can absorb large amounts of kinetic energy. The energy stored by such pump 410 into the pressure tank 411 will reduce the requirement of pressurized air from the aforesaid two pumps and therefore energy will be saved.

Applications

In the above specification I have indicated the various applications of the invention. I will now explain in more detail the particular modifications of the basic configuration of a Three-Rotor Device required for the various applications.

In the case of the Three-Rotor Device being applied as a Steam Engine, converting the pressure of steam into torque; as a hydrostatic engine converting the pressure of water into torque; as a geothermal engine and generally as an external combustion engine converting the pressure of hot gases into torque, the Three-Rotor Engine can be arranged to perform two-stroke cycles. In these cases all inlet ports are connected together allowing the fluid under pressure to enter all expanding chambers. Similarly all outlet ports are connected together allowing all contracting chambers to be emptied into whatever the sink is. Since there is no danger of misfiring, no forward limiting means are needed. The engine may be combined with auxiliary components such as those shown in FIG. 20 of said previous application.

As an internal combustion engine, the configuration of the Three-Rotor Engine may or may not be used in combination with fixed-volume pressure chambers and for executing complex thermodynamic cycles. For example, the inlet ports may be combined into a single inlet port and the outlet ports may be combined into a single exhaust port and the configuration may be used in a simple Otto cycle or a simple Diesel cycle. The engine can appropriately combine with such auxiliaries as shown in FIGS. 18 and 19 of said previous patent application now pending and to which the present application constitutes a continuation-in-part, to perform as a gasoline engine power plant or a Diesel engine power plant, respectively. Note that such engines can be water-cooled or air-cooled with the space allocated in the preferred embodiment to the fixed volume pressure chambers 29*b* and 29*c* and to the spiral ducts in 29*d*, for the exhaust gases, to be used for the flow of the coolant, water or air.

As a pump the device having the configuration of a Three-Rotor Engine can function as a two-stroke device with all the inlets connected to a single inlet connected to the lower pressure region and communicating with all expanding chambers. Similarly all the outlets can be combined into a single outlet connected to the higher pressure region and communicating with all the contracting chambers. In the case of a pump, since the energy during the device comes from the center shaft, no reverse rotation limiting means are needed. But forward rotation limiting means are necessary since both rotors will be forced forward by torque applied through the center shaft. Self-operated pressure valves may or may not be a part of the pump and may be contained in the load.

As a fluid-measuring device, the Three-Rotor configuration may be in the form of a pump or in the form of an engine depending on whether the fluid to be measured possesses pressure or not. For example, since the water comes under pressure, a water meter can be an engine, while for measuring gasoline in a gasoline station, the device operates as a pump.

I claim:

1. A rotary device comprising:

a stationary housing;

a first side rotor;

a second side rotor;

an output power shaft;

a center rotor, connected directly or indirectly with said power shaft, rotating at substantially uniform velocity in a forward direction with respect to said housing, its rotation having a predetermined functional relationship to the sum of the rotations of said first and said second rotor;

a cavity of revolution of genus 1 about an axis, including surfaces belonging to at least said first side rotor and said center rotor;

a first set of *n* diaphragms connected to said center rotor;

a second set of *n* cavity diaphragms connected to said first side rotor and alternated with said first set of *n* diaphragms inside said cavity, thereby separating the cavity in 2*n* chambers, each chamber thus being bounded along the side by a portion of the surface of said cavity of revolution and at the ends by surfaces belonging to the two cavity diaphragms, one end belonging to said center rotor, the other end to said first side rotor, with the circular geometry providing a continuous sequence of such chambers, circumferentially disposed around the axis, wherein alternately the volume of half the chambers is increased while the volume of the remaining other half of the chambers is being equally decreased as said first side rotor and said center rotor are forced to rotate with respect to each other by alternately one side rotor accelerating to substantially twice the rotational velocity of said center rotor while the other side rotor is decelerating to zero rotational velocity with respect to said housing, such increasing and decreasing of the volume of the chambers representing the execution of a plurality of predetermined strokes, the sequence of such strokes representing a preprogrammed cycle;

reverse action engaging means for tranfering torque from one side rotor to the other side rotor and to said center rotor by movably engaging said first side rotor and said second side rotor, using said center rotor as a pivot in a manner that a torque exerted between said center rotor and one of the side rotors causes a substantially equal and opposite torque between said center rotor and the other side rotor, said engaging means further keeping the angles between said center rotor and each of said side rotors substantially equal, and transfering torque stroke programming means for preprogramming the strokes to be performed by each of the aforesaid chambers at predetermined time intervals;

means for limiting the rotation of said first side rotor and said second side rotor in a predetermined direction; and means for intaking energy, alternately causing said first side rotor and said second side rotor to be rotated through a predetermined angular displacement further causing said center rotor to be rotated a predetermined amount of rotation.

2. The device of claim 1 wherein said cavity of revolution has a substantially rectangular cross section.

3. The device of claim 1 wherein said rotation limiting means are forward rotation limiting means for alternately limiting the rotation of said first side rotor then of said second side rotor in the forward rotational direction and wherein said means for intaking energy provide forward torque to said center rotor; the device further comprising a fluid intake means for intaking a fluid into expanding volume chambers and fluid outlet means for expelling the intaken fluid from contracting volume chambers; thereby the device providing pumping action.

4. The device of claim 1 wherein said rotation limiting means are reverse rotation limiting means for alternately limiting the rotation of said first side rotor then of said second side rotor in the reverse rotational direction and wherein said means for intaking energy are fluid intaking means allowing a fluid under pressure to reach the chambers while their volume is expanding, the pressure of the fluid alternately forcing one set of diaphragms in the forward direction while forcing the other set of diaphragms in the reverse rotational direction; the device further comprising:

means for expelling the intaken fluid; and means for transfering the rotation of said rotors into at least one output shaft;

thereby the device provides engine action, converting the pressure of a fluid into torque.

5. The device of claim 1 wherein said rotation limiting means is a reverse rotation limiting means for alternately limiting the rotational displacements in the reverse direction of said first side rotor and said second side rotor and wherein said energy intaking means is a fuel and/or air intaking means; the device further comprising:

means for transfering torque from said rotors to at least one output shaft; and means for expelling resulting exhaust gases;

thereby the device is providing internal combustion engine action converting fuel into torque.

6. The device of claim 1 wherein said rotation limiting means includes both reverse rotation limiting means and forward rotation limiting means for alternately limiting the rotational displacements of said first side rotor and said second side rotor; and wherein said energy intaking means is fuel and/or air intaking means; the device further comprising:

means for igniting the fuel in predetermined combustion chambers during predetermined time intervals, the resulting pressure forcing said first side rotor and said center rotor;

means for transfering torque from said rotors to at least one output shaft; and means for expelling resulting exhaust gases;

thereby the device is providing interval combustion engine action converting fuel into torque.

7. The device of claim 6 wherein said first set of cavity diaphragms and said second set of cavity diaphragms include sealing elements in contact with the surfaces belonging to other rotors or to the housing for efficiently separating one chamber from the next.

8. The device of claim 5 in combination with auxiliary components such as a water reservoir, a steam boiler, a steam condenser and a steam superheating component; thereby the device operates as a steam engine power plant.

9. The device of claim 7 in combination with auxiliary components such as a carborator, a starter, ignition system and storage battery; thereby the device operates as a gasoline engine power plant.

10. The device of claim 7 in combination with auxiliary components such as fuel injection pumps including injectors, a starter, and an air header; thereby the device operates as a Diesel engine power plant.

11. The device of claim 7 including an additional cavity of revolution in which said second side rotor and said center rotor provide *n* diaphragms into the additional cavity of revolution including surfaces belonging to at least said second side rotor and said center rotor.

12. The device of claim 7 including an additional cavity of revolution in which said first side rotor and said second side rotor provide each *n*/2 diaphragms into the additional cavity of revolution including surfaces belonging to at least said first side rotor and said second side rotor.

13. A device of claim 7 including an additional cavity of revolution in which said first side rotor and said center rotor each provide *n* diaphragms to a cavity of revolution including surfaces belonging to at least said first side rotor and said center rotor.

14. The device of claim 7 further comprising a lubrication system for lubricating surfaces which are in relative motion.

15. The device of claim 7, in which said rotation limiting means includes:

first rotor reverse rotation limiting means for limiting the effective rotation of said first rotor beyond a predetermined angle with respect to a referance zero angle of housing thereby forcing said second rotor's velocity to a value substantially twice that of said center rotor;

second rotor reverse rotation limiting means for limiting the effective rotation of said second rotor beyond a predetermined angle with respect to the reference zero angle of said housing, thereby forcing said first rotor's velocity to a value substantially twice that of said center rotor;

first side rotor forward motion limiting means for holding said first rotor from accelerating while said second rotor rotates at substantially twice the velocity of said center rotor and prior to said center rotor's reaching a predetermined rotational position with respect to said housing;

second side rotor forward motion limiting means for holding said second rotor from accelerating while said first rotor rotates at substantially twice the velocity of said center rotor and prior to said center rotor reaching a predetermined rotational position with respect to said housing; in which said reverse action engaging means comprise a differential gear means for adding the rotations of said first side rotor and said second side rotor, thereby said center shaft rotating at a rotational speed equal to the average speed of said first side rotor and said second side rotor.

16. The device of claim 15 wherein said stroke programming means includes at least one plate rotating with said center rotor and further includes appropriately spaces holes and slots on said rotors and/or on the housing:

17. The device of claim 16, wherein said stroke programming means are preprogrammed to service a two-stroke cycle.

18. The device of claim 16, wherein said stroke programming means are preprogrammed to service an Otto cycle.

19. The device of claim 16, wherein said stroke programming means are preprogrammed to service a Diesel cycle.

20. The device of claim 16 wherein said stroke programming means are preprogrammed to service a multi-stroke complex cycle including more than four strokes.

21. The device of claim 20 including strokes for converting heat from the body of the device into torque.

22. The device of claim 20 including strokes for converting heat contained in the exhaust gases into torque.

23. The device of claim 20 including strokes providing for the fuel to be detonated in one combustion chamber but expansion to take place in more than one chambers, for higher efficiency and for the reduction of the generation of pollutants such as the oxides of Nitrogen as a consequence of the shortening of the duration of elevated temperatures.

* * * * *